US006957765B2

(12) United States Patent
Howell et al.

(10) Patent No.: US 6,957,765 B2
(45) Date of Patent: Oct. 25, 2005

(54) PACKAGE HAVING LOCKING MECHANISM AND REINFORCED CELL

(75) Inventors: George Howell, Elmira, NY (US); Michael Paliotta, Horseheads, NY (US)

(73) Assignee: Howell Packaging a division of F.M. Howell & Company, Elmira, NY (US)

( * ) Notice: Subject to any disclaimer, the term of this patent is extended or adjusted under 35 U.S.C. 154(b) by 67 days.

(21) Appl. No.: 10/773,221

(22) Filed: Feb. 9, 2004

(65) Prior Publication Data

US 2005/0173505 A1 Aug. 11, 2005

(51) Int. Cl.[7] ..... B65D 5/06

(52) U.S. Cl. ..... 229/151; 229/152; 229/153; 229/160.2

(58) Field of Search ..... 229/102, 151, 229/152, 153, 160.2; 206/807

(56) References Cited

U.S. PATENT DOCUMENTS

| | | | | |
|---|---|---|---|---|
| 306,620 | A | | 10/1884 | Jaeger |
| 719,553 | A | | 2/1903 | Baldwin |
| 1,130,271 | A | | 3/1915 | Hammond |
| 2,925,212 | A | | 2/1960 | Welsh, Jr. |
| 2,928,581 | A | | 3/1960 | Graybill |
| 3,370,775 | A | | 2/1968 | Link |
| 3,543,995 | A | * | 12/1970 | Wilson ..... 229/102 |
| 3,692,231 | A | | 9/1972 | Neitzke et al. |
| 3,971,505 | A | | 7/1976 | Ohkubo |
| 4,479,588 | A | * | 10/1984 | Davis et al. ..... 229/151 |
| 4,614,297 | A | * | 9/1986 | Davis et al. ..... 229/153 |
| 4,752,028 | A | * | 6/1988 | Ogura ..... 229/102 |
| 4,887,764 | A | * | 12/1989 | Ogura ..... 229/102 |
| 5,236,122 | A | | 8/1993 | Ballard |
| 5,443,202 | A | | 8/1995 | Jorgensen-Beck et al. |
| 6,296,176 | B1 | * | 10/2001 | Frenois et al. ..... 229/153 |
| 6,860,421 | B2 | * | 3/2005 | Lo Duca ..... 229/153 |

FOREIGN PATENT DOCUMENTS

| | | | | |
|---|---|---|---|---|
| JP | 3-226451 | A | * 10/1991 | ..... 229/102 |

* cited by examiner

*Primary Examiner*—Gary E. Elkins
(74) *Attorney, Agent, or Firm*—Arent Fox PLLC

(57) ABSTRACT

A package having a locking mechanism and reinforced cell includes first, second, and third panels, wherein the first and third panels are foldable over each other. The reinforcing cell is defined by at least one flap of the third panel folded to have an edge engage an interior surface of the first panel. The locking mechanism is provided by an upper edge of the second panel being engaged by a top edge of the first panel. A push button provided on the second panel is used to disengage the locking mechanism.

17 Claims, 10 Drawing Sheets

PACKAGE HAVING LOCKING MECHANISM AND REINFORCED CELL

BACKGROUND OF THE INVENTION

1. Field of the Invention

This invention relates to a package having a locking mechanism and reinforced cell that prevents the package from being unintentionally opened or damaged, wherein the package may provide a user with access to the articles or products contained therein.

2. Description of the Related Art

It is common practice to package small solid articles or products in a manner wherein the contents can easily be dispensed while simultaneously deterring unauthorized individuals, e.g., children, from gaining access to the contents of the package. Since this type of packaging is critical in marketing medicines and other such pharmaceuticals, the invention will be referred to herein with respect to a package particularly suitable for such use, but it should be understood that the package may be used for other products as well, such as, for example only, tobacco products, foods, electronics, and the like. Historically, substantial efforts have been exerted in providing packaging that contains sufficient impediments to prevent children from easily opening the package and gaining access to the package articles or products while still providing adults with easy access to the articles or products contained therein.

In one example of such an effort, U.S. Pat. No. 2,925,212 to Welsh, Jr. teaches a single pre-cut and scored box blank having a front wall 10 and lid 15 with a latch mechanism. See FIG. 5. The front wall 10 has been cut at 19 to form a tongue member 20 that is integral at its base with the front wall 10 in which it is formed. The lid 15 has a flap 16 at its front end. The flap 16 is also cut at 22 to provide a tongue member 23 that is integral at its base with the flap 16. The tongue member 23 is sized and configured such that when the flap 16 is in the closed position, tongue members 20 and 23 will be substantially coextensive and will lie adjacent each other.

The latch mechanism operates as follows: normally, the tongue 23 and flap 16 lean in an outward position. When the lid 15 is closed, the flap 16 is tucked down behind the front wall 10 such that the outwardly leaning tongue 23 will engage the abutment formed by cut away portions 21, 21' in panel extensions 17, 17'. The engagement of the tongue 23 with the underside of the top edges of the cut away portions 21, 21' tends to retain the lid 15 in the closed position. However, when tongue 23 is deflected inwardly, tongue 23 is forced back into the plane of flap 16 and out of contact with the edges of cut away portions 21, 21'.

The inherent resiliency of the folded material will frequently cause the lid 15 to deflect at least a short distance upwardly. The lid is easily grasped and lifted to give access to the contents of the box. When the box is closed again back replacing the lid, the outward inclined tongue 23 will again engage the upper edge of cut away portions 21, 21' to secure lid 15 in its closed position until released again.

FIG. 8 of Welsh illustrates an alternative embodiment wherein the tongue 24 is formed as an extension of flap 16, which is then folded upward about the lower most edge of the flap. FIG. 9 illustrates the operation of this embodiment. In particular, tongue 24 latches in the closed position underneath the upper most edge of cutaway portions 21, 21'.

In another example, U.S. Pat. No. 719,553 to Baldwin teaches a box fastener for a body 1 and movable lid 2 of a box. See FIG. 2. The box 1 has a double wall front with an outer wall 3 and an inner wall 3' at a front side of the body 1. The outer wall 3 has an opening 7 therein. The movable lid 2 has a flat-piece 5 having a raised projection 6 that is shaped to be received in the opening 7 when the lid 2 is closed, wherein the projection 6 acts against the edge wall thereof to hold and fasten the lid 2 in a closed position. To open the lid 2, a user pushes the projection 6 until the projection 6 reaches a position where the projection 6 is no longer acting on the opening 7 and the lid 2 can freely be opened.

In yet another example, U.S. Pat. No. 306,620 to Jaeger teaches a paper box that can be used to package cigarettes. The box has a body A having an open end that is closed by flap B. A partition D extends from a side panel (not identified) and includes another partition C extending from a side thereof. As shown in FIGS. 2–4, the partition D is folded over a score line so as to define a space for the flap B to be inserted between the partition D and a front panel (not identified) of the box. The other or second partition C extends in a direction away from the first partition D in a direction that is perpendicular to the partition D so as to define a compartment C' that is used to store items, such, as for example, a cigarette holder, lighter, etc.

There is a need in the industry to provide a package that is rigid and less inclined to permitting unintended or otherwise unauthorized individuals from gaining access to the contents of the package by simply crushing the package. Furthermore, there is a need in the industry to provide such a package that is less flexible and includes a locking mechanism that prevents the package from being opened.

SUMMARY OF THE INVENTION

It is an aspect of the present invention to provide a package having a locking mechanism and a reinforced cell to prevent the unauthorized or unintended opening of the package and to reduce the flexibility of the package wherein the package can only be opened by disengaging the locking mechanism.

According to an aspect of the present invention, the package has a top flap including a locking tab and a partition panel defining a space within which the top flap is inserted to prevent the top flap from being opened. The package is made of a one piece blank that is scored, cut, and folded to arrive at the final configuration. A front panel of the package includes a generally hemi-cylindrical cut line defining a push button. When the blank is folded, a flap secured by a score line to the top of the front panel is folded along the score line and is adhered to an inner side of the front panel. The now lower edge of the flap is situated just above the top of the hemi-cylindrical cut line when the package is in an upright position.

A top closure is provided on the back panel of the package and includes a top panel, a tongue flap, and a lock flap connected to the free end of the tongue flap by a score line. The lock flap is folded back against the tongue flap. The now upper edge of the lock flap once folded engages the lower edge of the flap to lock the cover down. To release the lock flap from the lower edge of the flap, the push tab is pushed inwardly pushing the lock flaps inwardly of the package, and the upper edge of the lock flap is released from the lower edge of the flaps so the top closure can be opened.

The partition panel includes a side panel to which a corresponding side panel of the front panel is adhered when the package is assembled, an upper flap, and a lower flap. At least one of the upper and lower flaps are folded 90° relative to the face of the partition panel such that a free edge of each flap may engage an inner surface of the back panel. As a result, a rigid cell is formed when assembly of the package is complete.

In operation, the lock flap and tongue flap of the top closure are inserted into the cell space defined by the partition panel and front panel, which prevents the top closure from being opened. The cell reduces the flexibility of the package and restricts the top closure from movement once the free edge of the lock flap engages the lower edge of the flap. The upper and lower flaps of the partition panel severely reduce the amount of flexibility of the partition panel, thereby reducing the chance of the top closure from being forced open without having to depress the push release button.

BRIEF DESCRIPTIONS OF THE DRAWINGS

Other aspects and features of the present invention will be better understood from the following description, with reference to the accompanying drawings, wherein.

DETAILED DESCRIPTION OF THE PRESENT INVENTION

Figure 1:
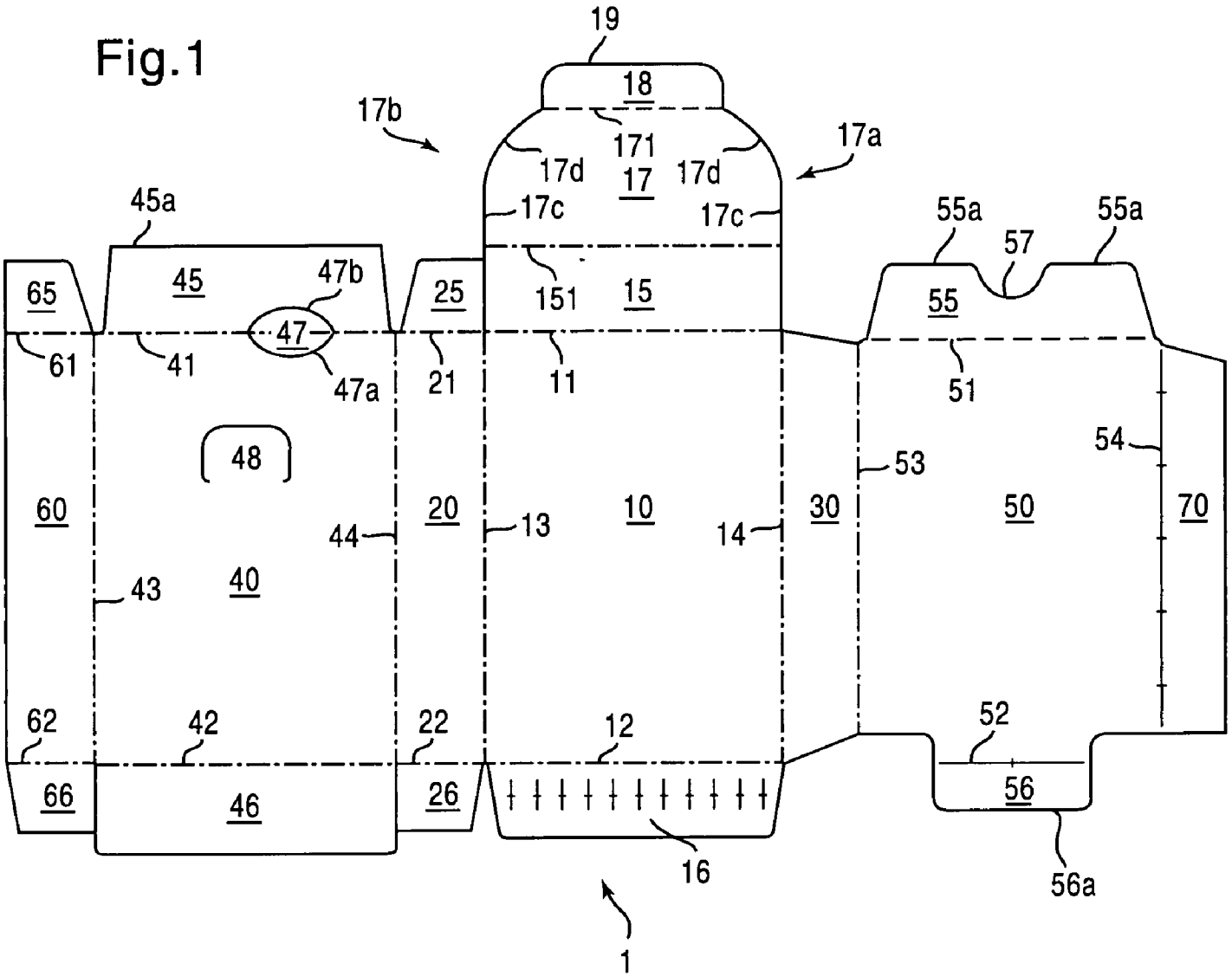
FIG. 1 is a top view of a disassembled one piece blank used to form the package according to an embodiment of the invention.

Referring to FIG. 1, a preferred embodiment of the present inventin is shown as the package 1 formed from a flat, substantially rectangular shaped single blank, ideally made from paperboard. However, it is within the scope of this invention to use any suitable material well known or later developed in the art, such as, for example, paper, plastic, metal, natural or synthetic, and the like. Furthermore, although not illustrated but well understood in the art, it is within the scope of this invention to use any suitable geometric shape, such as, for example, square, trapezoidal, circular, oval, and the like to form the package 1.

The package 1 includes a first panel 10 separated from a second panel 40 by a first side panel 20. The first panel 10 and first side panel 20 are separated by score line 13 while the first side panel 20 is separated from the second panel 40 by score line 44. The first panel 10 is also separated from a third panel 50 by a second side panel 30. The first panel 10 is separated from the second side panel 30 by score line 14 while the second side panel 30 is separated from the third panel 50 by score line 53.

The first panel 10 includes a score line 11 at a top edge substantially parallel and opposite a score line 12 at a bottom edge of the first panel 10. The score lines 11 and 12 at the top and bottom edges, respectively, are orthogonal relative to the score lines 13 and 14, respectively.

A top flap 15 is separated from the first panel 10 by score line 11 and extends away from the first panel 10. A bottom flap 16 is separated from the first panel 10 by score line 12 and extends away from the first panel 10 in a direction opposite the top flap 15. A score line 151 defining a top edge of the top flap 15 is substantially parallel and opposite the score line 11.

A first extension panel 17 is separated from the top flap 15 by score line 151 and extends away from the top flap 15 and first panel 10. In an embodiment, first and second sides 17*a* and 17*b* of the first extension panel 17 may each be defined by a straight portion 17*c* and a curved portion 17*d*. The straight portions 17*c*, 17*c* of the first and second sides 17*a* and 17*b* of the first extension panel 17 are substantially parallel and opposite each other. Moreover, the curved portions 17*d*, 17*d* of the first and second sides 17*a* and 17*b* of the first extension panel 17 extend from an end of a corresponding straight portion 17*c* to an end of a score line 171 defining a top edge of the first extension panel 17. The score line 171 is substantially parallel and opposite the score line 151. In an embodiment, the score line 171 may be shorter than the score line 151.

A second extension panel 18 is separated from the first extension panel 17 by score line 171. A top edge 19 of the second extension panel 18 is substantially parallel and opposite to the score line 171.

The first side panel 20 includes a score line 21 defining a top edge of the first side panel 20 and another score line 22 defining a bottom edge of the first side panel 20. The score lines 21 and 22 are substantially parallel and opposite each other. A top flap 25 is separated from the first side panel 20 by score line 21 and extends away from the first side panel 20. A bottom flap 26 is separated from the first side panel 20 by score line 22 and extends away from the first side panel 20 in a direction opposite relative to the top flap 25.

The second panel 40 includes a score line 43 substantially parallel to and opposite score line 44. A score line 41 defining a top edge of the second panel 40 is substantially parallel to and opposite a score line 42 defining a bottom edge of the second panel 40. A top flap 45 is separated from the second panel 40 by score line 41 and extends away from the second panel 40. A bottom flap 46 is separated from the second panel 40 by score line 42 and extends away from the second panel 40 in a direction opposite relative to the top flap 45.

A cut out 47 is formed at the top edge of the second panel 40 and a bottom edge of the top flap 45. The cut out 47 is defined by a cut line 47*a* formed in the top edge of the second panel 40 and a cut line 47*b* formed in the bottom edge of the top flap 45. Although cut out 47 is illustrated in FIG. 1 has having an oval geometric shape, it is within the scope of the invention to form the cut out 47 to be, such as, for example, circular, triangular, rectangular, elliptical, trapezoidal, or any other suitable geometric shape. A push button 48 is defined in a central region of the second panel 40 by a hemi-cylindrical cut line 49 extending along at least three sides of a perimeter of the push button 48.

A third side panel 60 extending away from score line 43 of the second panel 40 includes a score line 61 defining a top edge of the third side panel 60 and another score line 62 defining a bottom edge of the third side panel 60. The score lines 61 and 62 are substantially parallel and opposite each other. A top flap 65 is separated from the third side panel 60 by score line 61 and extends away from the third side panel 60. A bottom flap 66 is separated from the third side panel 60 by score line 62 and extends away from the third side panel 60 in a direction opposite relative to the top flap 65.

The third panel 50 includes a score line 51 defining a top edge 55*a* of the third panel 50 that is substantially parallel to and opposite a fold line 52 defining a bottom edge 56*a* of the third panel 50. A top flap 55 is separated from the third panel 50 by score line 51 and extends away from the third panel 50. It is within the scope of the invention to provide a cut away 57 formed in a top edge of the top flap 55. Although the cut away 57 is illustrated as being semicircular in shape, it is within the scope of the invention to provide the cut away 57 as having any suitable geometric shape, such as, for example, square, rectangular, elliptical, trapezoidal, and the like. A bottom flap 56 is separated from the third panel 50 by score line 52 and extends away from the third panel 50 in a direction opposite relative to the top flap 55. Although the bottom flap 56 is illustrated as having a shorter width relative to a width of the third panel 50, it is within the scope of the invention to provide the bottom flap 56 with a width that is substantially equivalent to the width of the third panel 50. A fourth side panel 70 extends away from the fold line 53 of the third panel 50.

It should be noted that in one embodiment, the score line 11 of the first panel 10, the score line 21 of the first side panel 20, the score line 41 of the second panel 40, and the score line 61 of the third side panel 60 are co-linear. Accordingly, the top flap 15 of the first panel 10 is adjacent the top flap 25 of the first side panel 20, which is adjacent the top flap 45 of the second panel 40, and which is adjacent the top flap 65 of the third side panel 60 when the package 1 is not yet formed.

Similarly, in one embodiment, the score line 12 of the first panel 10, the score line 22 of the first side panel 20, the score line 42 of the second panel 40, and the score line 62 of the third side panel 60 are offset. In other words, while the score lines 12, 22, 42, and 62 are parallel, they do not lie on the same line. Accordingly, the bottom flap 16 of the first panel 10 is adjacent the bottom flap 26 of the first side panel 20, which is adjacent the bottom flap 46 of the second panel 40, and which is adjacent the bottom flap 66 of the third side panel 60 when the package 1 is not yet formed.

Furthermore, as will become clear from the following discussion, an adhesive region G having an adhesive is provided on an inner side of the top flap 45, an inner side of the lower flap 46, an outer side of the second side panel 30, and an outer side of the fourth side panel 70. Moreover, the adhesive may be any known or later developed adhesive, such as, for example only, glue. The adhesive region G may cover the entire face of the top flap 45, bottom flap 46, second side panel 30, and fourth side panel 70 or be provided on at least two separate locations of the top flap 45, bottom flap 46, second side panel 30, and fourth side panel 70, so long as the top flap 45 can be adhered to the second panel 40, the bottom flap 16 can be adhered to the bottom flap 46, the first side panel 20 can be adhered to the fourth side panel 70, and the third side panel 60 can be adhered to the second side panel 30.

Figure 2:
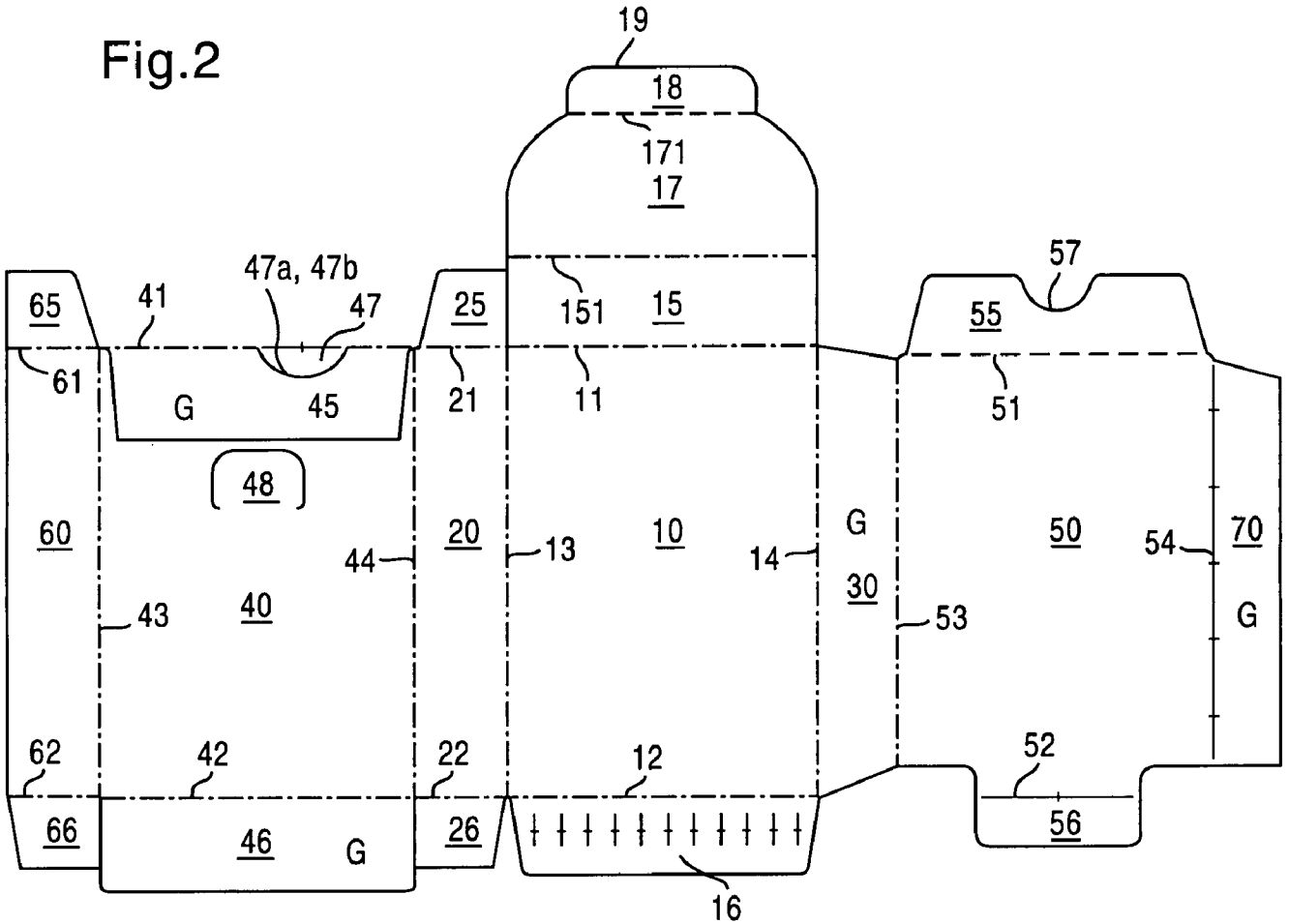
FIG. 2 is a top view showing a top panel of the package folded over onto a second panel of the package of FIG. 1.
Figure 3:
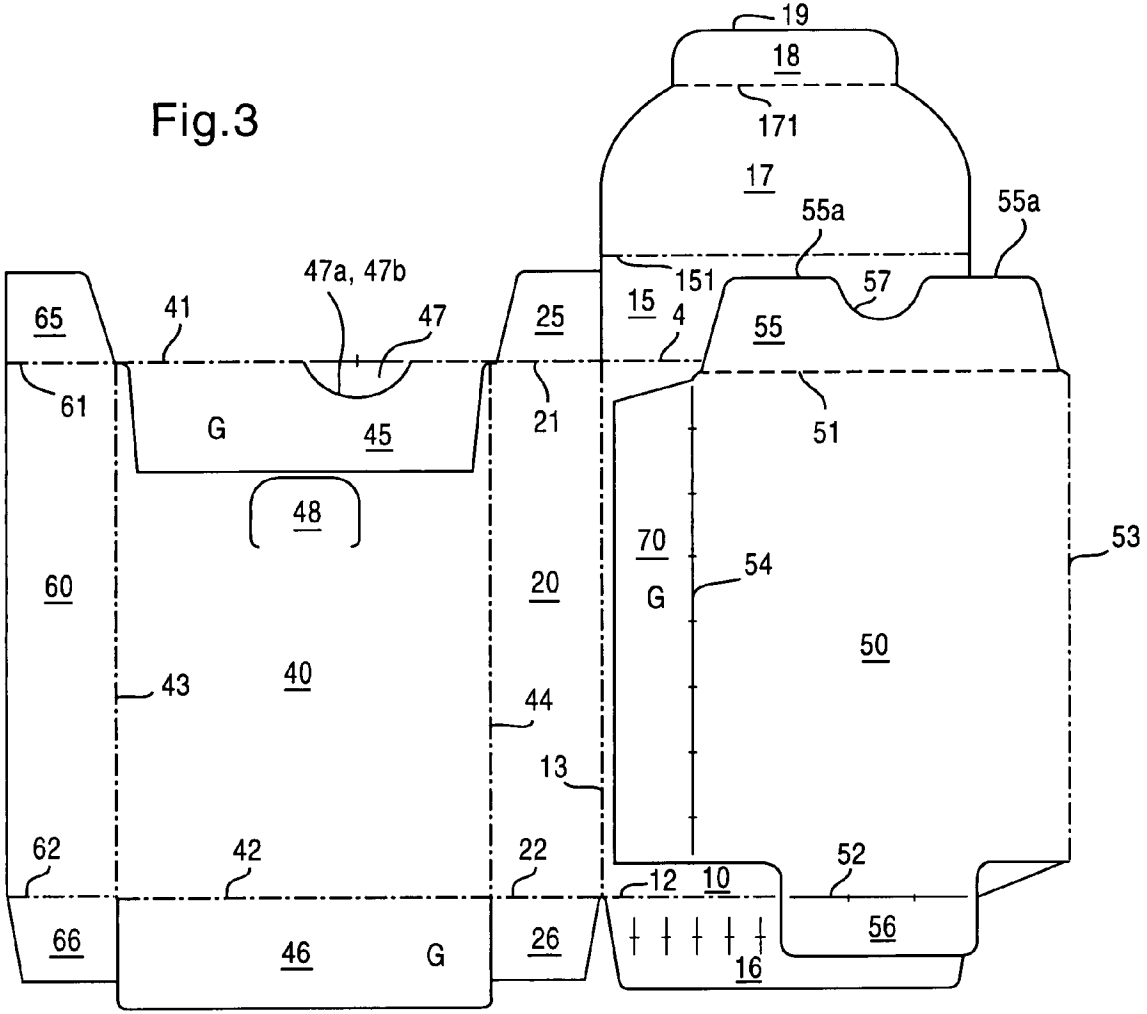
FIG. 3 is a top view showing a third panel of the package folded over onto a first panel of the package of FIG. 2.
Figure 4:
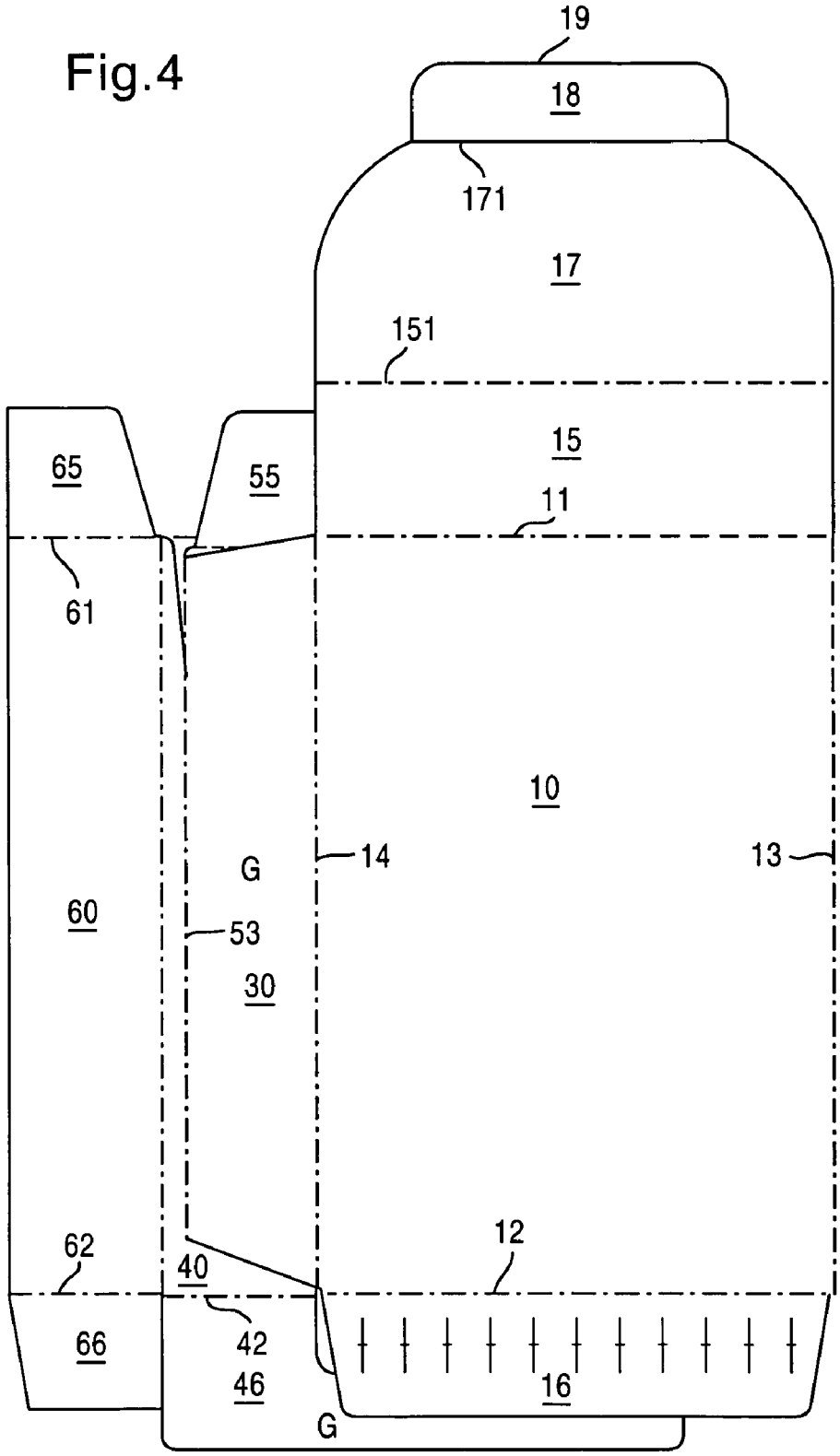
FIG. 4 is a top view showing the first panel and third panel of the package folded over onto the second panel of the package of FIG. 3.
Figure 5:
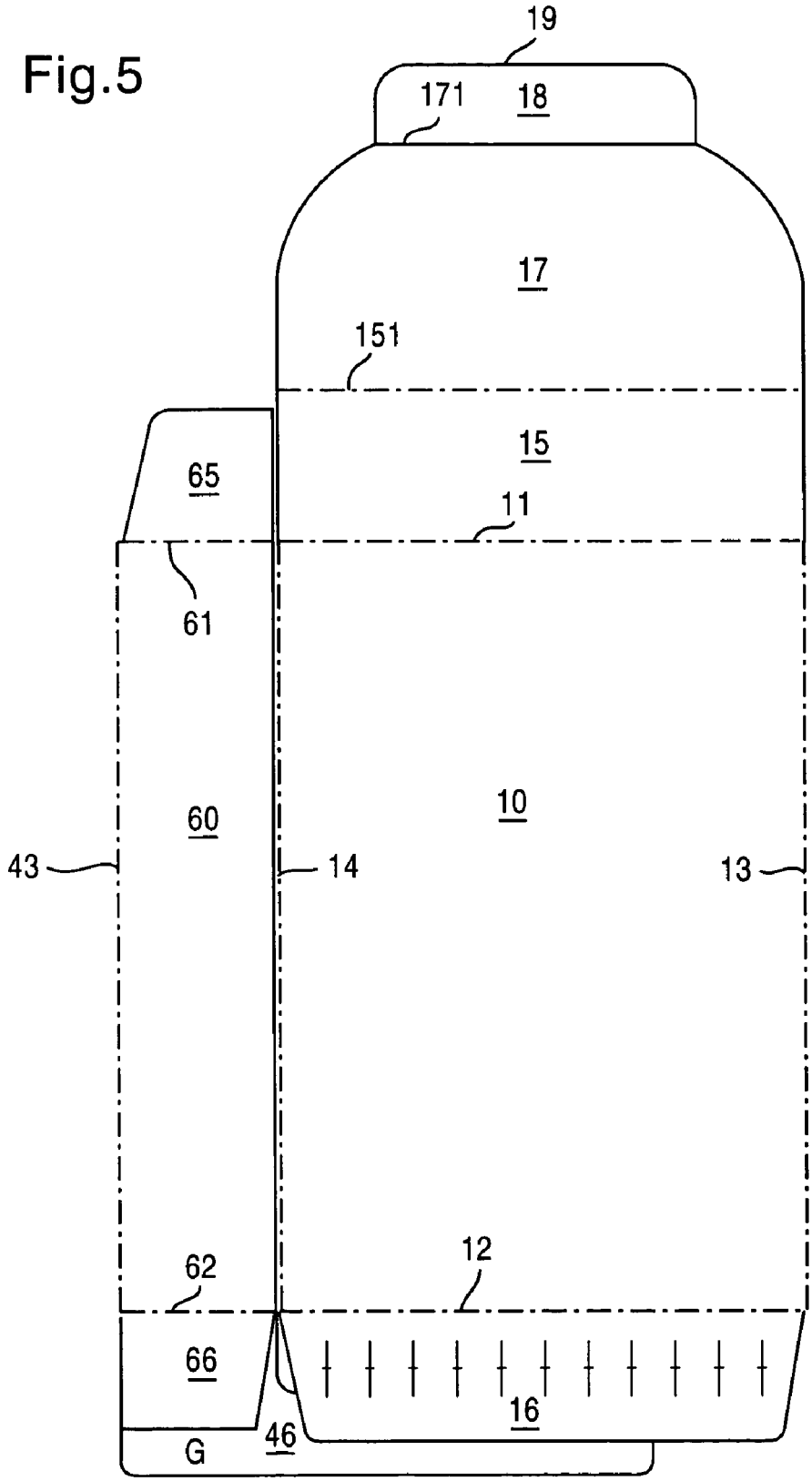
FIG. 5 is a top view showing a third side panel of the package folded over the second panel of the package of FIG. 4.

To form the package 1, as shown in FIG. 2, the top panel 45 is folded over score line 41 and adhered to the second panel 40 such that the cut line 47*b* overlaps similarly configured cut line 47*a*. It should be noted that at this time, the cut out 47 is not yet removed. The third panel 50 is folded over score line 53 onto the first panel 10, as shown in FIG. 3. The first panel 10 and third panel 50 are folded over score line 13 and an adhesive is applied to the adhesive region G of the second side panel 30, as shown in FIG. 4. The third side panel 60 is folded over score line 43 and is adhered to the adhesive in the adhesive region G of the second side panel 30, wherein the second side panel 30 is covered by the third side panel 60, as shown in FIG. 5.

Figure 6:
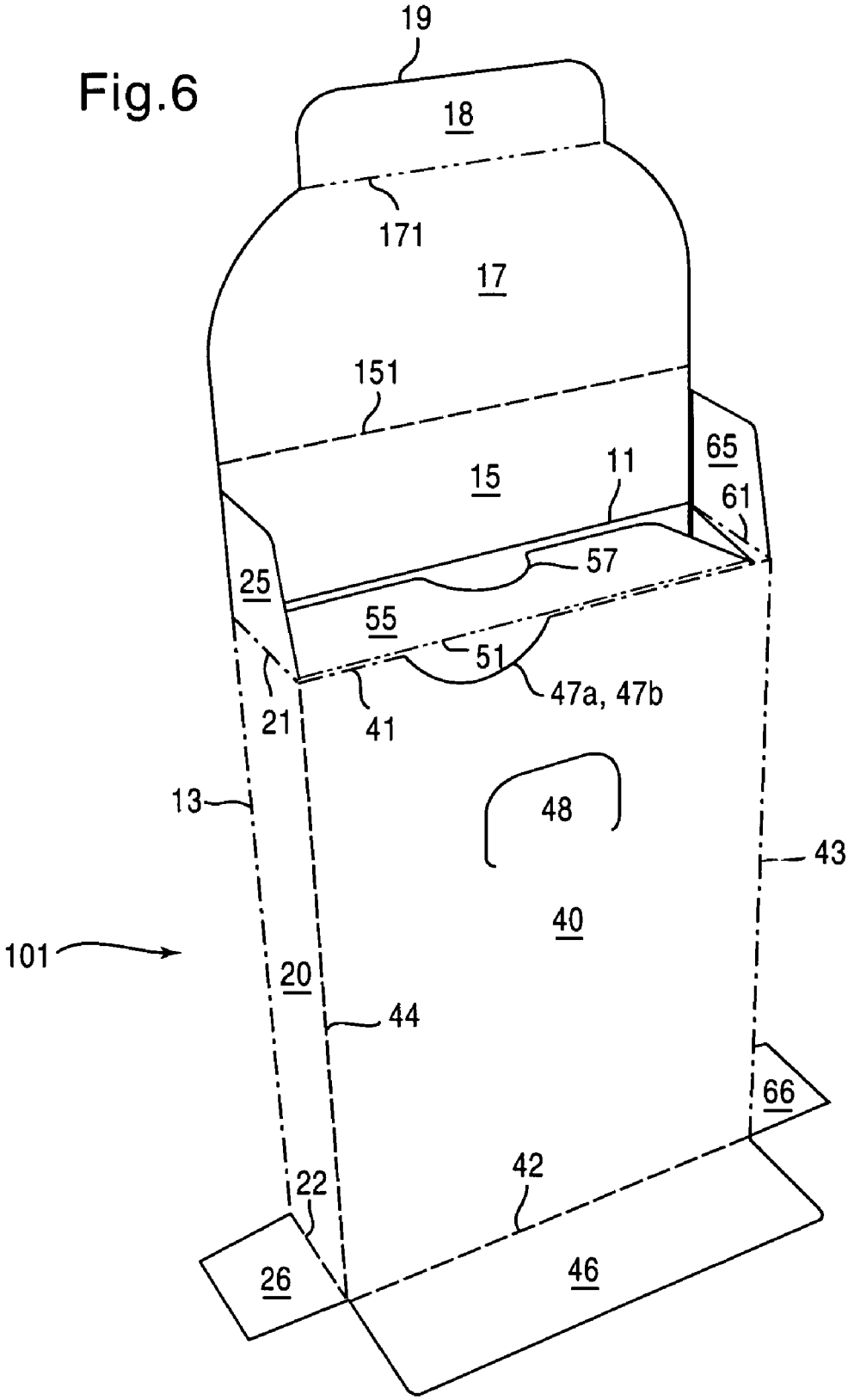
FIG. 6 is a perspective view of a sleeve which is formed into the package according to an embodiment of the present invention.
Figure 7:
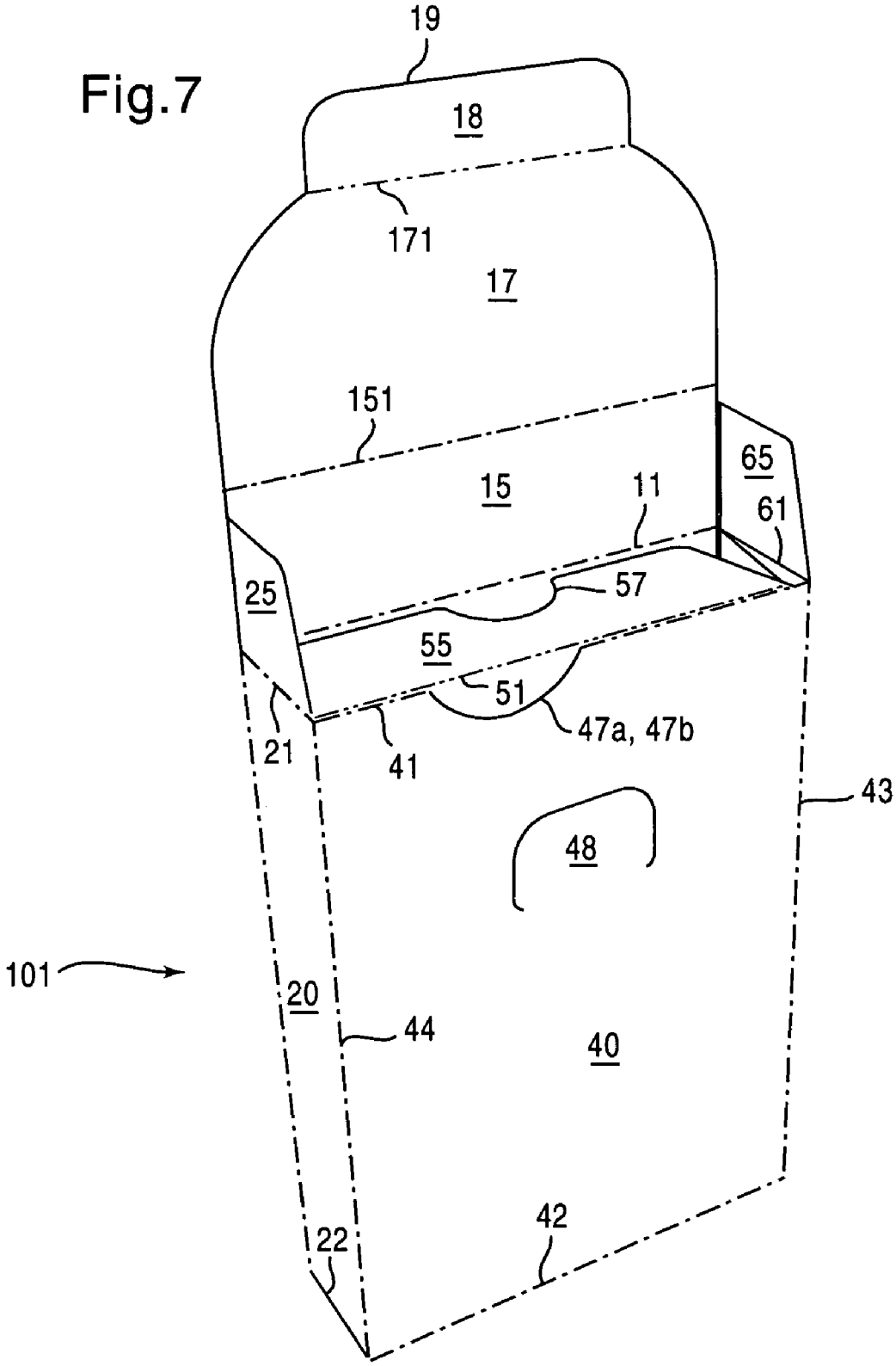
FIG. 7 is a perspective view of the sleeve of FIG. 6 wherein the bottom flaps of the package are folded over each other to close a bottom opening of the sleeve.

Pressure is applied, either manually, such as by an individual, or automatically, such as by a mechanical or electrical apparatus, to score lines 13 and 43 to form a sleeve 101, as shown in FIG. 6. An adhesive is applied in the adhesive region G of the bottom flap 46 and the bottom flaps 26 and 66 of the first side panel 20 and third side panel, respectively, are folded over their corresponding score lines 22 and 62, respectively. The bottom flap 16 is folded over score line 12 and onto the folded bottom flaps 26 and 66. The bottom flap 46 is folded over score line 42 and adhered to the bottom flap 16 to close an open end of the sleeve 101, as shown in FIG. 7.

Figure 8:
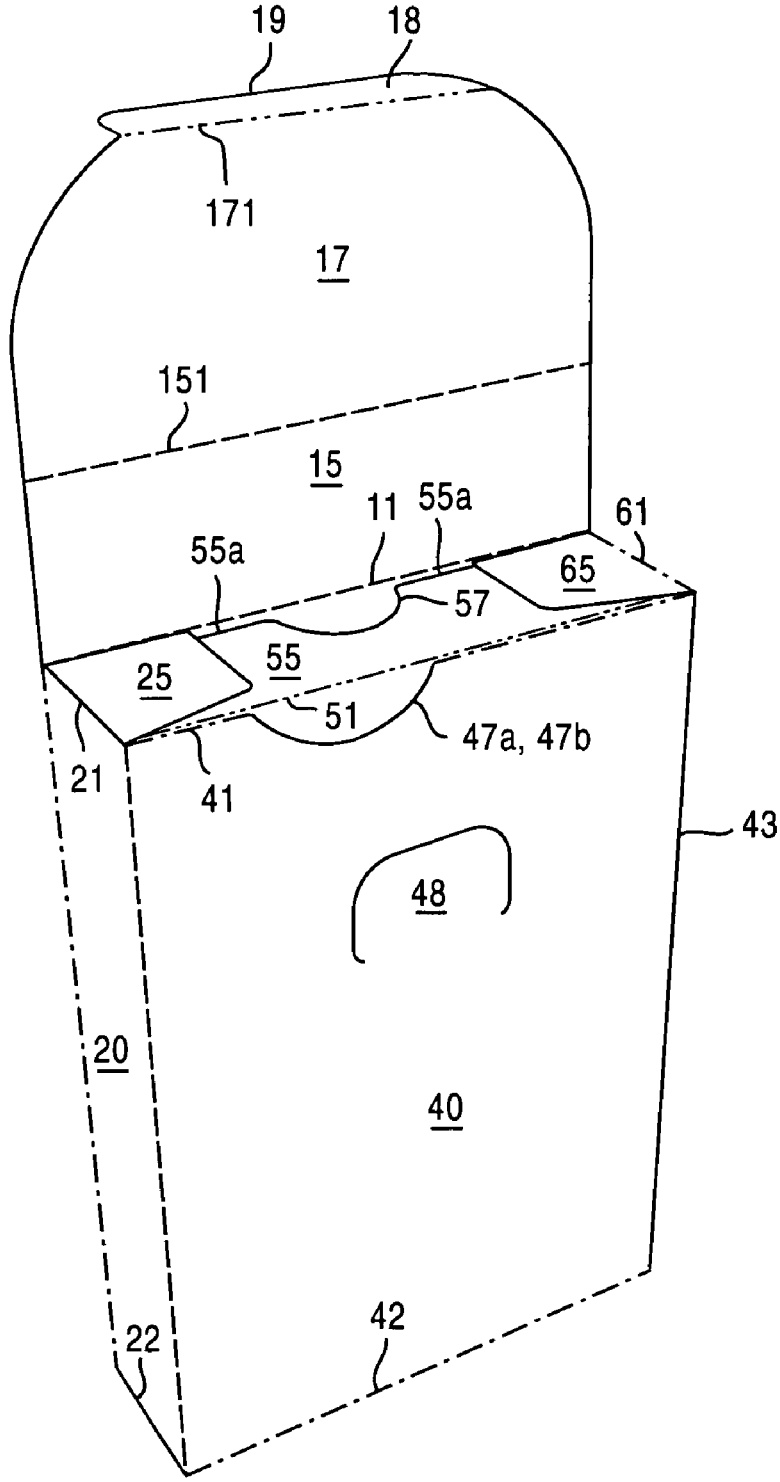
FIG. 8 is a perspective view of the of the sleeve of FIG. 7 wherein the top flaps of the package are folded over to partially close a top opening of the sleeve and complete assembly of the package.

The top flap 55 of the third panel 30 is folded 90° over score line 51 so an upper edge 55*a*, 55*a* of the flap 55 contacts an inner face of the first panel 10. It should be noted that, although not shown, it would be obvious to one of ordinary skill in the art, the bottom flap 56 of the third panel 50 may be folded 90° over the fold line 52 so that a lower edge 56*a* of the flap 56 touches or otherwise engages the interior surface of the first panel 10. Top flaps 25 and 65 of the first and third side panels 20 and 60, respectively, are folded over corresponding score lines 21 and 61, respectively, as shown in FIG. 8. The upper edges 55*a*, 55*a* of the top flap 55 and the lower edge 56*a* of the bottom flap 56 of the third panel 50 which engage or otherwise contact the inner surface of the first panel 10 provide a reinforced or rigid cell that prevents the assembled package 1 from being crushed or otherwise damaged which might permit children to gain access to the contents of the package 1. The rigid cell substantially reduces the flexibility of the third panel 50, which reduces the chances of the top flap 15 from being forced open without having to disengage the locking mechanism. Moreover, the overlapping side panels 20, 30, 60, and 70 may be used to assist the assembled package 1 from being crushed or otherwise damaged.

Figure 9:
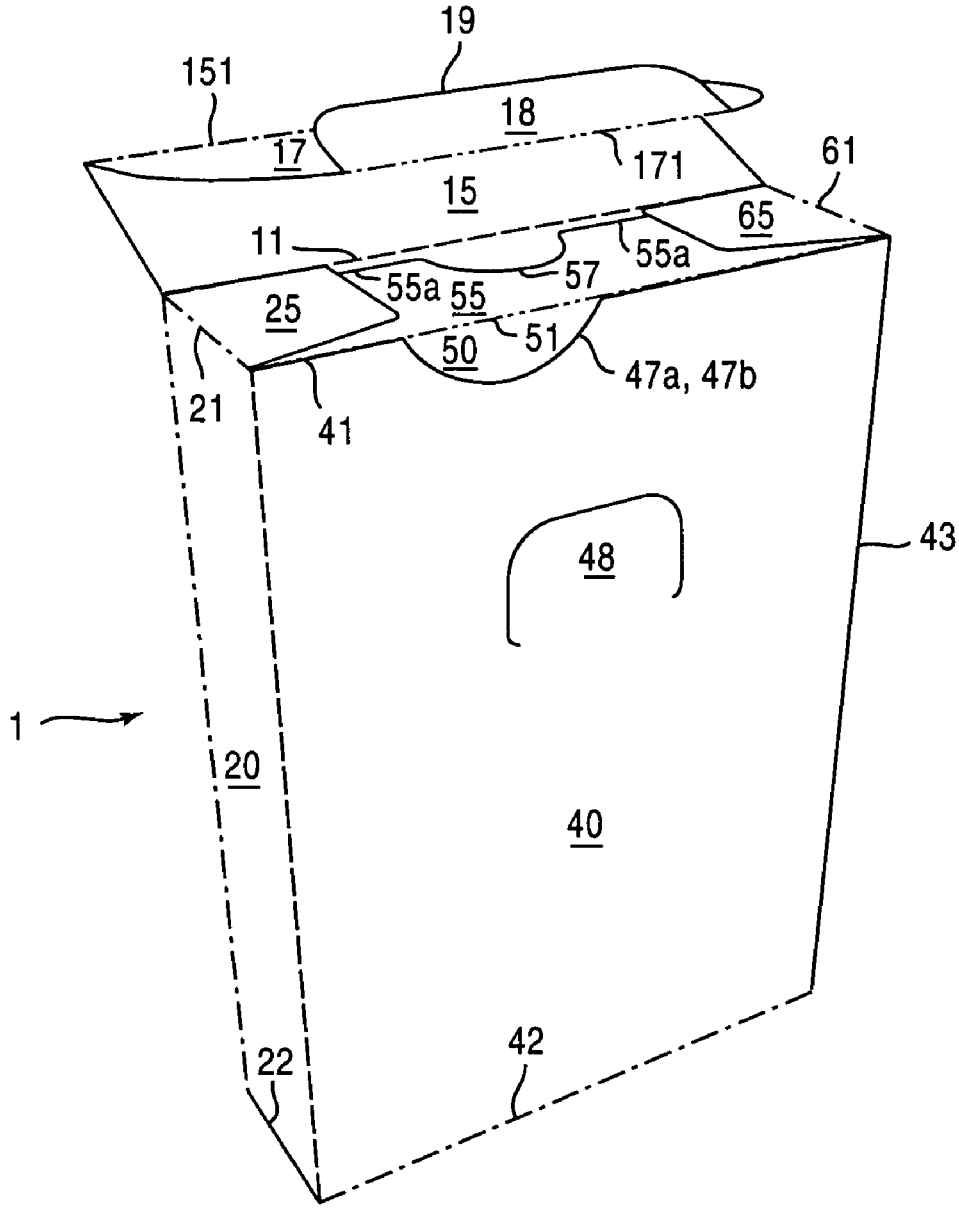
FIG. 9 is a perspective view of the sleeve of FIG. 8, wherein the first and second expansion panels are partially folded over each other to more fully close the top opening of the sleeve and complete assembly of the package.
Figure 10:
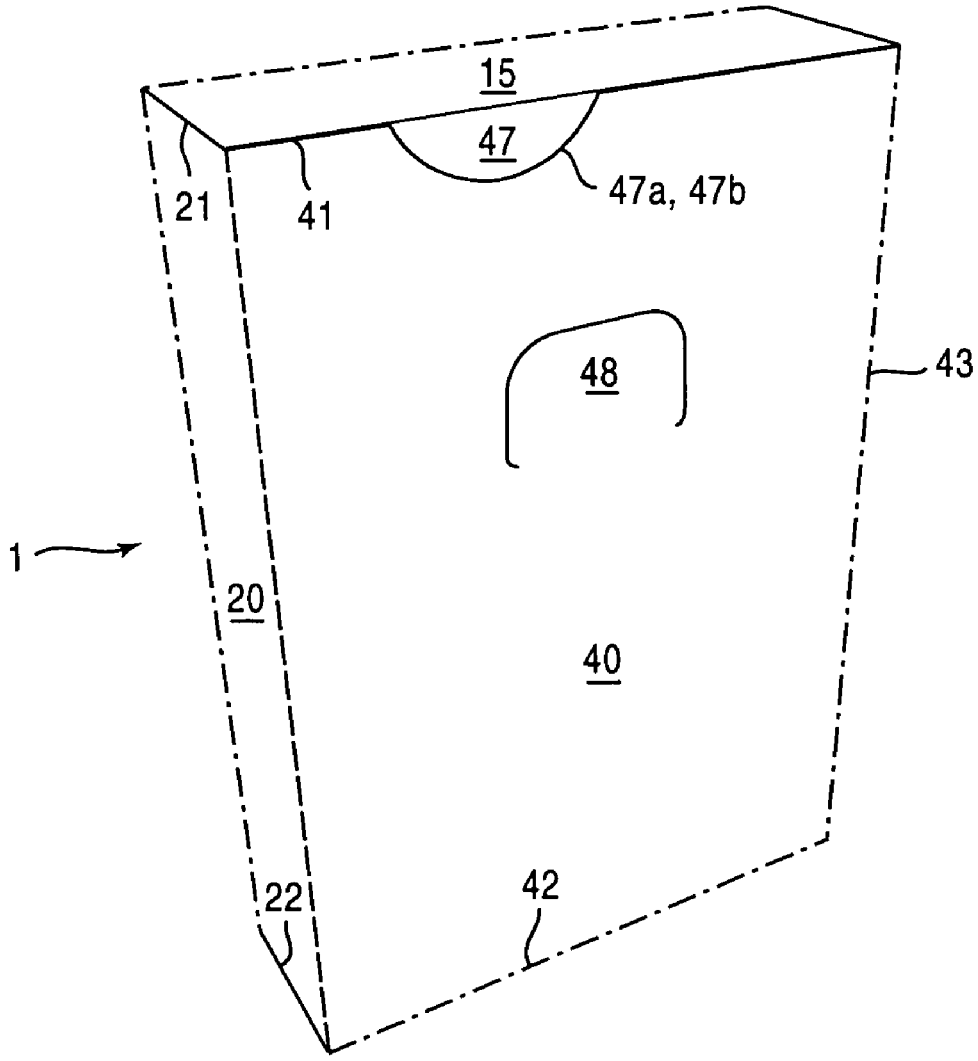
FIG. 10 is a perspective view of the fully assembled package according to an embodiment of the invention.

As shown in FIG. 9, the second extension panel 18 is folded over score line 171 onto a rear face of the first extension panel 17, which is folded over score line 151. The first and second extension panels 17 and 18, respectively, are then manipulated into a cell space defined in an area between the overlapping first and third panels 10 and 50, respectively, to form a package 1 having a reinforced or rigid cell. See FIG. 10. The reinforced or rigid cell is defined by the upper edges 55*a*, 55*a* of the top flap 55 and lower edge 56*a* of the bottom flap 56 contacting the first panel 10. The reinforced or rigid cell may further be defined by the overlapping side panels 20, 30, 60, and 70, respectively.

Furthermore, when the package 1 is formed as described above, the top edge 19 of the second extension panel 18 engages an upper edge 45*a* of the top flap 45 to provide a locking mechanism, which prevents the top flap 15 of the package 1 from being unintentionally opened. The cell also prevents the top flap 15 from movement once the top edge 19 engages the upper edge 45*a*. Furthermore, the top flap 55 significantly reduces the amount of flexibility of the third panel 50, which reduces the chance the top flap 15 can be forced open without depressing the push button 48. To release the locked flap 18 from the upper edge 45*a* of the top flap 45, the push button 48 is depressed or pushed inwardly, which releases the top edge 19 of the second extension panel 18 from the upper edge 45*a* of the top flap 45 and the top flap 15 is removable from the package 1.

Many modifications may be made to adapt the teachings of the package of this invention to particular situations or materials without departing from the scope thereof. For example, the above-described manner of forming the sleeve 101 before formation of the package 1 is complete is in no way intended to be limiting but is merely exemplary as it is well known in the art that the package 1 can be formed using a number of conventional techniques that are standard to the folding carton industry.

Accordingly, the invention should not be limited to the particular embodiments disclosed herein, but includes all embodiments within the spirit and scope of the disclosure.

We claim:

1. A package having a locking mechanism and reinforced cell, comprising:

a blank having:

a first panel having a top flap extending away from a top edge of the first panel and an extension panel extending away from a top edge of the top flap, a second panel, and a third panel, wherein the third panel is foldable over the first panel, and the first and third panel are foldable over the second panel;

a first side panel disposed between the first and second panels;

a second side panel disposed between the first and third panels;

a third side panel extending away from a side of the second panel;

a fourth side panel extending away from a side of the third panel, wherein the first side panel overlaps the fourth side panel and the third side panel overlaps the second side panel;

reinforcing means for reinforcing the cell formed by the overlapping first and third panels, wherein the extension panel is slidable into a cell space created between the overlapping first and third panels; and a locking mechanism provided at a top edge of the second panel, wherein the reinforcing means is provided on the third panel and engages an interior face of the first panel, and wherein the locking mechanism engages the extension panel to place the package in a locked state and releases the extension panel of the first panel to place the package in an unlocked state.

2. The package according to claim 1, wherein the reinforcing means comprises a top flap extending from a top edge of the third panel, wherein the top flap of the third panel is foldable over a score line at the top edge of the third panel.

3. The package according to claim 2, wherein the top flap of the third panel comprises at least one upper edge which engages the interior face of the first panel.

4. The package according to claim 2, wherein the top flap of the third panel comprises a pair of upper edges separated by a cut away and wherein the pair of upper edges engage the interior face of the first panel.

5. The package according to claim 2, wherein the top flap of the third panel folds approximately 90° over the score line at the top edge of the third panel.

6. The package according to claim 2, wherein the reinforcing means further comprises a bottom flap extending away from a bottom edge of the third panel, wherein the bottom flap of the third panel is foldable over a fold line at the bottom edge of the third panel.

7. The package according to claim 6, wherein the bottom flap of the third panel comprises a bottom edge which contacts the interior face of the first panel when bent over the fold line at the bottom edge of the third panel.

8. The package according to claim 6, wherein the bottom flap of the third panel folds approximately 90° over the fold line at the bottom edge of the third panel.

9. The package according to claim 1, further comprising a top flap extending away from the second panel, and wherein the locking mechanism further comprises an upper edge of the top flap of the second panel.

10. The package according to claim 1, further comprising a release means provided on the second panel.

11. The package according to claim 10, wherein the release means includes a push button defined by a hemicylindrical cut line formed in the second panel.

12. The package according to claim 1, wherein the extension panel comprises a first extension panel and a second extension panel extending away from the first extension panel, wherein the first extension panel is disposed between the top flap of the first panel and the second extension panel.

13. The package according to claim 12, wherein the second extension panel has a smaller surface area than a surface area of the first extension panel.

14. The package according to claim 12, further comprising a top flap extending away from the second panel, and wherein the locking mechanism further comprises an upper edge of the top flap of the second panel.

15. The package according to claim 14, wherein the upper edge of the top flap of the second panel engages the top edge of the second extension panel.

16. The package according to claim 14, further comprising a release means provided on the second panel.

17. The package according to claim 16, wherein the release means includes a push button defined by a hemicylindrical cut line formed in the second panel.

* * * * *